United States Patent [19]

Moberg

[11] 4,392,832

[45] Jul. 12, 1983

[54] STEERING AND PROPULSION SYSTEM FOR MARINE USE

[76] Inventor: Carl E. Moberg, P.O. Box 1828, Seattle, Wash. 98111

[21] Appl. No.: 276,075

[22] Filed: Jun. 22, 1981

[51] Int. Cl.[3] ..... B63H 23/02; B63H 3/08

[52] U.S. Cl. ..... 440/49; 74/710.5; 277/25; 277/29; 416/156; 440/50; 440/59; 440/75; 440/78

[58] Field of Search ..... 74/710.5, 713; 277/DIG. 6, 177, 206 R, 29, 25; 416/147, 156, 157 R, 157 A, 157 B, 146 A, 146 B; 440/49, 50, 53, 58, 59, 75, 76, 78, 79, 81, 83

[56] References Cited

U.S. PATENT DOCUMENTS

| | | | |
|---|---|---|---|
| 1,931,733 | 10/1933 | Leibing | 277/25 |
| 2,386,362 | 10/1945 | Soldner | 440/75 X |
| 2,401,796 | 6/1946 | Raitch | 74/710.5 |
| 2,415,421 | 2/1947 | Filippis | 416/156 |
| 2,844,421 | 7/1958 | Hayman | 277/DIG. 6 |
| 2,936,730 | 5/1960 | Patty, Jr. | 440/75 X |
| 3,228,705 | 1/1966 | Underwood | 277/206 |
| 3,703,296 | 11/1972 | Malmstrom | 277/25 |

*Primary Examiner*—Sherman D. Basinger
*Attorney, Agent, or Firm*—Dowrey & Cross

[57] ABSTRACT

A universal steering and propulsion unit for marine craft utilizes a power train which includes a differential gearing unit with control of the power delivered being accomplished through selective braking of one side of the differential. Steering may be accomplished by a 360° rotating ability of the propeller without interruption of the power delivered to the propulsion unit. The power train also provides a special gearing arrangement whereby the propeller drive shaft may be driven so as to provide forward thrust regardless of the direction of rotation of the output drive shaft of the power unit, thus obviating the necessity for oppositely rotating output shafts when dual drive units are required. The oil pressure about the propeller shaft and gear transfer housing is used for feathering the propeller blades.

10 Claims, 7 Drawing Figures

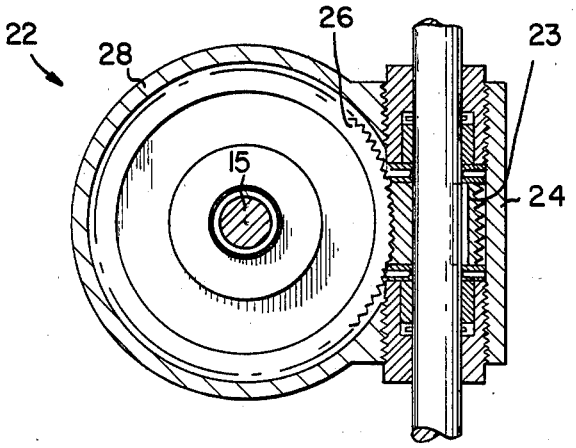
FIG. 4
FIG. 5
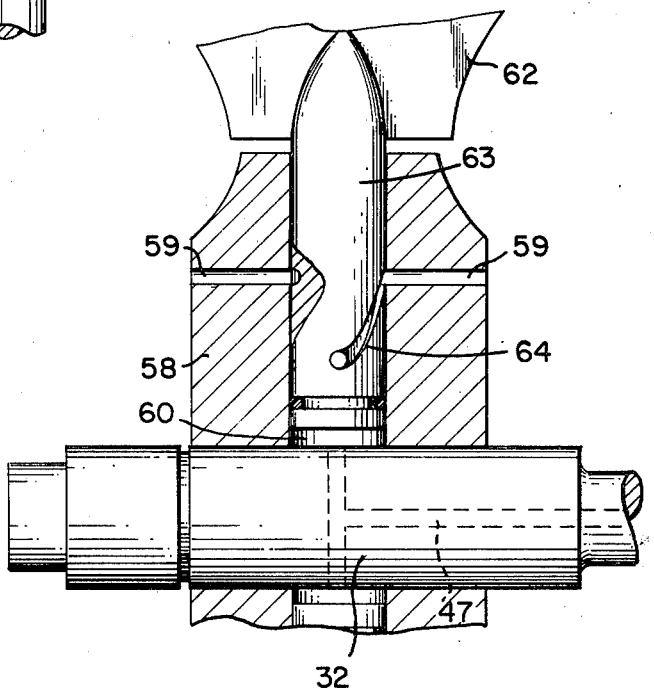
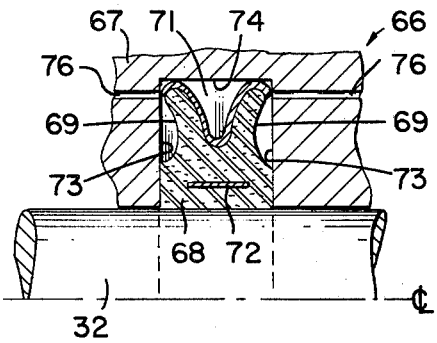
FIG. 6
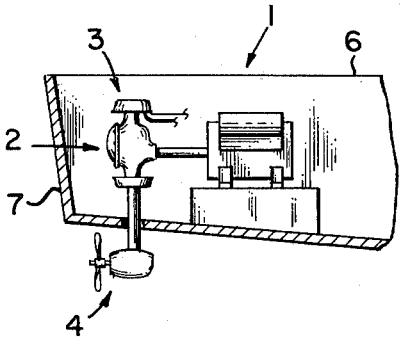
FIG. 7

STEERING AND PROPULSION SYSTEM FOR MARINE USE

BACKGROUND OF THE INVENTION

1. Field of the Invention

The present invention relates to a universal steering and propulsion unit for use with marine craft. The system is universal in the sense that it may be installed wherever the propeller thrust is needed and gives the operator immediate control of the amount and direction of propeller thrust. It is universal also in the sense that it may be mounted either inboard or outboard of the boat hull. More particularly, the propulsion unit utilizes a source of motive power such as an internal combustion engine and a power train which includes a differential gearing unit with control of the power delivered being accomplished through selective braking of one side of the differential. Steering may be accomplished by a 360° rotating ability of the propeller without interruption of the power delivered to the propulsion unit. The power train also provides a special gearing arrangement whereby the propeller drive shaft may be driven so as to provide forward thrust regardless of the direction of rotation of the output drive shaft of the power unit, thus obviating the necessity for oppositely rotating output shafts when dual drive units are required.

The invention also includes a novel sealing arrangement for the propeller shaft which takes advantage of centrifugal force to direct seeping fluid away from the shaft. Another novel feature of the invention is the use of the oil pressure about the propeller shaft and gear transfer housing for feathering the propeller blades.

2. Description of the Prior Art

Although prior art marine propulsion systems have been devised which utilize either a constant speed power source and a clutch arrangement for disengaging the propeller shaft from the power source or such devices as variable speed electrical motors directly coupled to the propeller shaft, the most common arrangement involves a power source such as an internal combustion engine, a clutch and a transmission assembly for varying the power to the propeller shaft as well as the direction of rotation. The problem of directional thrust or reverse thrust has also been solved in some instances by providing a propeller assembly which will rotate through 360°, thus providing directional thrust from a constant speed power source. Such examples are U.S. Pat. No. 1,021,408 to Haschke, U.S. Pat. No. 2,930,342 to Wanzer, U.S. Pat. No. 3,415,216 to Strobel, U.S. Pat. No. 3,723,839 to Cramer, and U.S. Pat. No. 1,034,987 to Ducasson.

SUMMARY OF THE INVENTION

The present invention provides a much improved power train for a boat steering and propulsion system which adapts itself to installation at any place on a ship or boat where propeller thrust is required. According to the present invention, the operator has immediate control of the amount and the direction of propeller thrust. This is accomplished by incorporating the well proven differential gearing unit such as utilized in many automobiles for control of the power transferred to the propeller without the use of clutch or transmission, and steering control is accomplished by 360° rotation of the propeller unit. To effect this control, a brake drum is provided for one output shaft of the differential and may be selectively controlled by conventional manual or hydraulic means. The amount of power transmitted to the propeller shaft is thus governed by the braking pressure applied to the one shaft of the differential. As will be understood by those familiar with the art of differential gearing, in the conventional unit where one shaft is stopped, full power is applied to the other output shaft and, in the present case, this full power is transferred to the propeller. According to another feature of the invention, control of the propeller may also be enhanced by a novel hydraulically operated feathering device which utilizes the pressurized lubricating oil in the propeller gear box and transmission shafts. With almost instantaneous control of the feathering of the propeller blades, the power transmitted to the propeller and the 360° rotational ability of the propeller unit, it may be understood that the efficiency and maneuverability of the craft is greatly enhanced.

In addition to the enhanced efficiency and maneuverability obtained through the power train and steering control, a novel sealing engagement is provided about the propeller shaft such that fluid seeping into, or out of, the propeller mechanism is redirected back to its source. Also, fluid pressure in either direction along the shaft serves to enhance the sealing engagement of the seal means, thus enabling the pressurization of the propeller shaft housing and preventing oil spill.

BRIEF DESCRIPTION OF THE DRAWINGS

FIG. 4 is a cross-sectional detail taken along line 4—4 of FIG. 3 showing the worm gear steering mechanism;

FIG. 5 is a partially sectioned elevation showing the propeller hub and feathering mechanism;

FIG. 6 is a cross-sectional detail illustrating the shaft seal; and

FIG. 7 is a schematic illustrating an arrangement for mounting the control system inboard of a boat.

DESCRIPTION OF THE PREFERRED EMBODIMENTS

Figure 1:
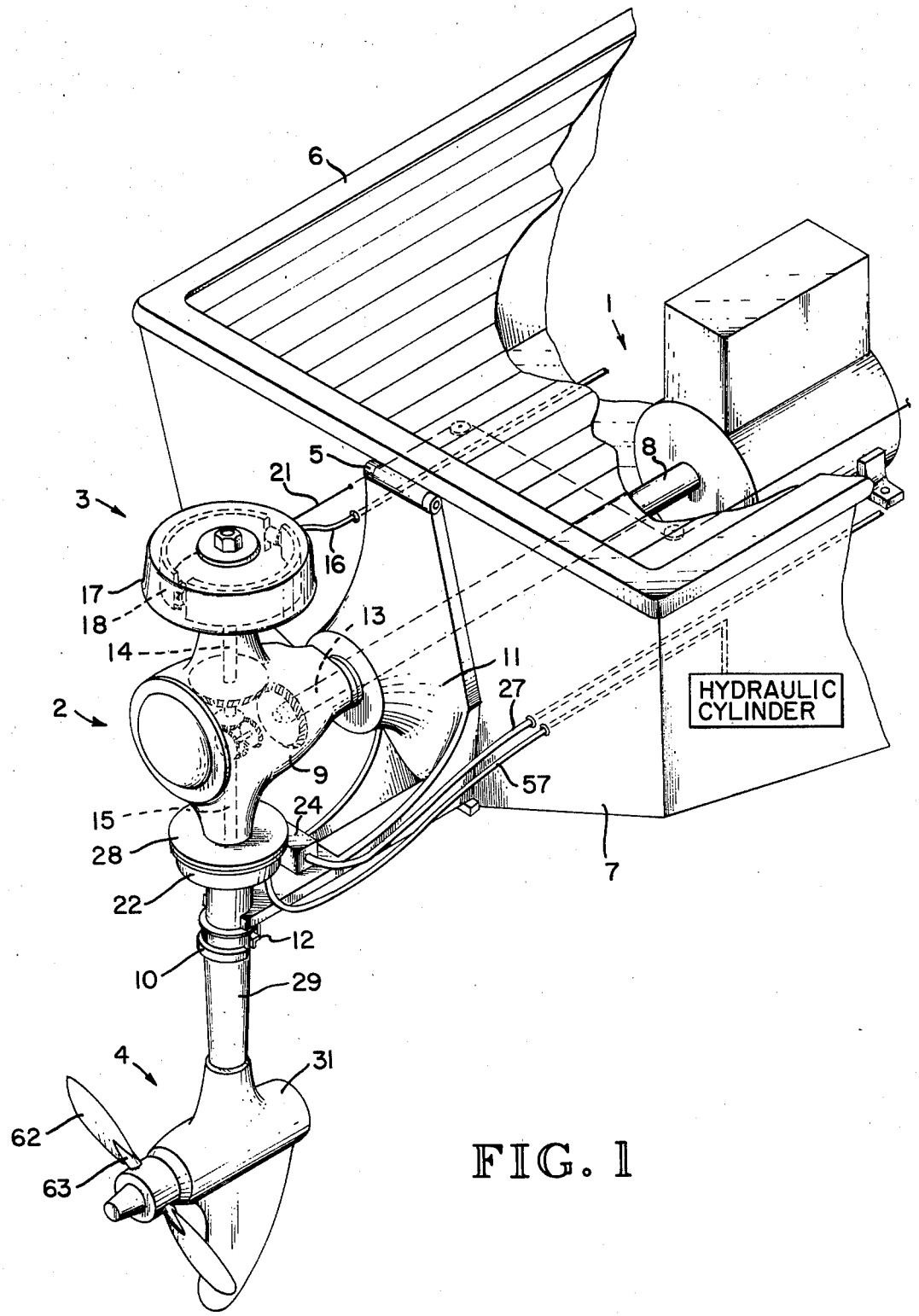
FIG. 1 is a perspective view of the steering and propulsion system of the present invention as it appears mounted outboard of a small boat.

Referring to FIG. 1, the steering and propulsion system includes a prime mover, indicated generally at 1, a standard differential gearing unit 2, a variable pressure brake 3 and a rotatable steering propeller or thrust unit 4. In the embodiment shown in FIG. 1, the system is mounted with the prime mover located within the hull of a small boat 6 in a conventional manner, and the differential, brake and propeller units are carried on the transom 7 at the stern of the boat hull.

the prime mover 1 may be any suitable conventional type such as gasoline or diesel engine and can be mounted within the hull 6 to suit the particular hull design and power requirements. The engine output shaft 8 extends through the transom 7 in any known manner, and it will be understood that any conventional bearing and seal may be adapted by those skilled in the art for the purpose. In the illustrated embodiment, the housing 9 of a conventional differential gear unit 2 is suitably connected to the mounting plate 11 carried on the transom 7. The output shaft 8 will be suitably drivingly connected to the input pinion shaft 13 of the differential unit 2 so as to drive both output shafts of the differential unit in a well known and conventional manner. If the propulsion unit is pivotally connected to the transom unit 7 at, for example, a horizontal hinge 5, reverse anti-swing bracket 10 will engage the bracket 12 when the vertical drive shaft housing is rotated to prevent upward swinging of the propelling unit due to reverse thrust. It is considered to be well within the skill of the art to mount the propulsion unit in a stationary position, or to pivot the differential unit and/or the vertical drive shaft and propeller shaft about a horizontal axis in any well known manner.

Figure 2:
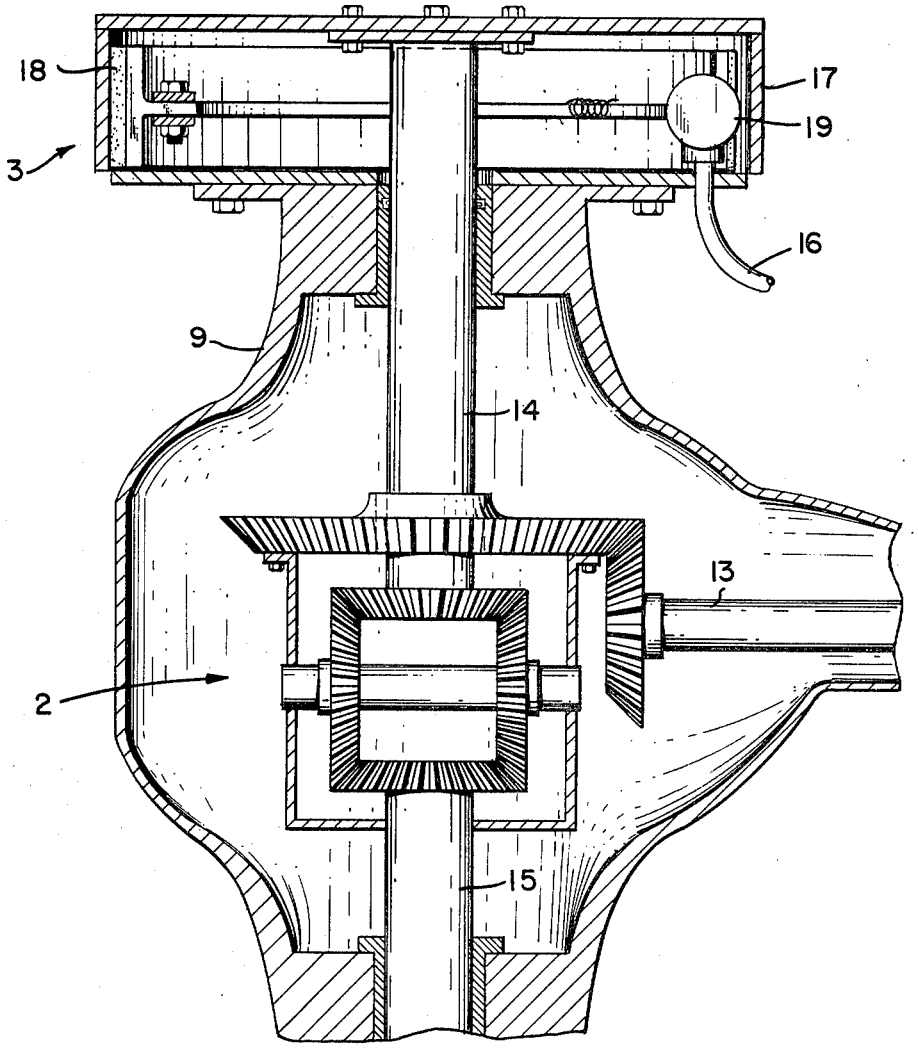
FIG. 2 is a schematic cross-sectional view of the differential gearing and braking mechanisms.

The differential gear unit 2 is shown only schematically in FIGS. 1 and 2 since many conventional and commercially available differential units, such as the type commonly used in rear wheel drive automobile gear trains, will suffice. Although the details of the differential design are not illustrated and form no part of the present invention, it will be understood that the unit is of the type that has a single input shaft and oppositely directed output shafts extending at right angles to the input shaft. The conventional differential operates in such a manner that power is transferred equally to each output shaft and, by braking one output shaft, the total available power or torque is transferred to the opposite output shaft in the proportion that braking pressure is applied. With full braking of one output shaft, full power is applied to the other output shaft, the vice versa.

In the embodiment illustrated, the downwardly extending output shaft 15 will have the propeller unit 4 mounted at its lower end. The upper output shaft 14, identical to the lower shaft 15, is provided with a brake assembly 3 mounted on the differential housing 9, illustrated most clearly in FIG. 2. The brake unit, shown schematically in FIG. 1, may be of any conventional design such as drum brakes commonly used in automobiles.

As is best seen in FIG. 2, the conventional friction braking means may include a brake drum 17 mounted on the shaft 14, and brake shoes 18 mounted in fixed relation to the differential housing and activated by, for example, a conventional hydraulic cylinder 19 connected to hand or foot operated control means by the line 16. Mechanical means such as a cable system with a manually operated cable 21 can also be provided. It is to be understood that alternative braking arrangements, for example, one in which the drum is within brake shoes which exert inward pressure, are within the scope of the invention. Control means for the braking system can be mounted remotely, so as to be applied selectively and with variable pressure by the operator.

In a preferred embodiment, both the hydraulic and the cable operating means will be provided. The hydraulic means may be actuated by a foot-operated pedal (not shown) to provide variable braking pressure, thereby varying thrust. The cable means may also include means for locking the braking mechanism in a fully braked position, similar to the locking means in a car's emergency or parking brake system. This would be of advantage when the vessel is in open waters where full thrust for an extended period of time is desired.

Figure 3:
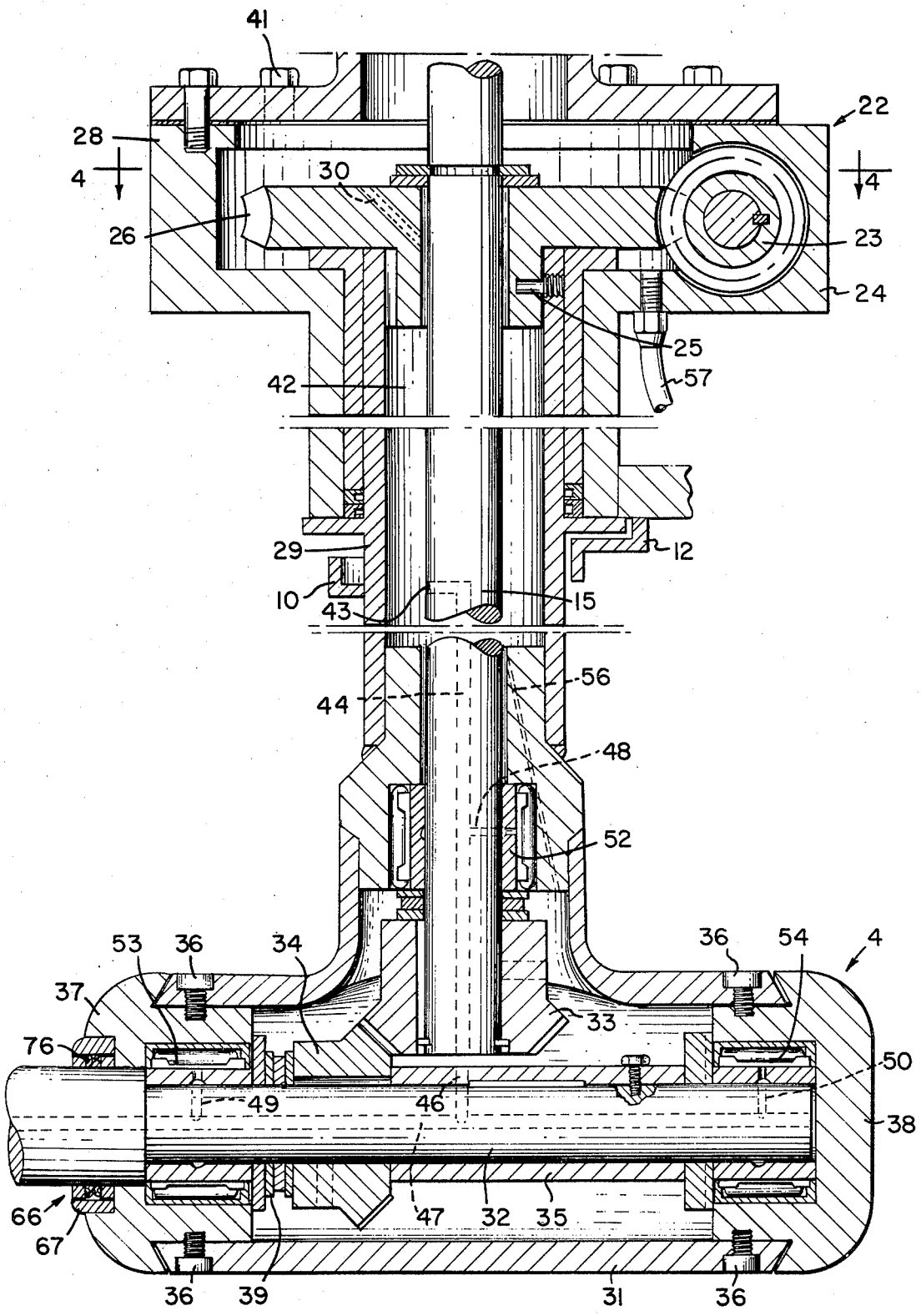
FIG. 3 is a cross-sectional view of the steering and propeller units.

Below the differential unit 2 is the steering means 22 which, referring to FIGS. 3 and 4, comprises a worm gear 23 in a housing 24, which is meshed with a gear 26 inside a steering unit housing 28. The worm gear 23 is controlled by any motor or manually controlled conventional means well known in the marine propulsion art such as a flexible shaft drive, connected to the worm gear by cable 27. Rotational movement of the worm gear 23 will cause rotation of the gear 26 and the drive shaft housing 29 connected thereto by means such as the set screw 25. Propeller unit 4 is welded or otherwise fixed to the bottom end of the housing 29 and hence is rotated about the vertical output drive shaft 15.

The propeller unit 4, which includes a propeller gear box 31 containing the propeller drive shaft 32, is mounted at the end of the shaft 15. The propeller shaft 32 and output shaft 15 are coupled by a first spiral bevel gear 33 which rotates with the output shaft 15, and a second spiral bevel gear 34 mounted on the propeller shaft 32 and meshed with the first.

An important feature of the invention is that the propeller unit can be easily adapted to accommodate either direction of output shaft rotation. To switch the propeller shaft 32 from right-handed to left-handed rotation, or vice versa, the four bolts 36 are removed, permitting the end covers 37 and 38 to be disengaged from the gear box 31. The shaft 32, thrust bearing 39, spiral gear 34 and spacer sleeve 35 may then be withdrawn from the gear box. These elements may then be rearranged with the spiral gear 34 and thrust bearing 39 on the side of driving shaft 15 opposite their original position prior to replacement in the gear box 31. In other words, the positions of the spacer sleeve and the thrust bearing/spiral gear assembly are reversed from that shown in FIG. 3. This easy reversal of propeller rotation, made possible by the unique spiral bevel gear coupling between the driving shaft and propeller shaft, eliminates the need for oppositely rotating output shafts when dual drive units are required, and is an easy operation that can be performed by a person having only minimal mechanical skill.

Another novel feature of the invention is the use of the system's lubricating oil to adjust the pitch of the propeller blades. The steering and propulsion unit will be lubricated with oil or other lubricating fluid, which is introduced into the system through a fill plug 41 on top of the steering unit housing 28. The oil will flow from the interior of the housing 28, through the passage 30 in gear 26, and into the space 42 between the shaft 15 and shaft housing 29. An opening 43, positioned at some point along the length of the shaft 15, will allow the oil to flow into a bore 44, downward through the shaft 15 and into the propeller gear box 31. An opening 46 in the spacer sleeve 35 allows oil to flow into the bore 47 in the shaft 32.

Passageways 48, 49 and 50 in the output shaft 15 and propeller shaft 32 direct oil to bearings 52, 53 and 54 respectively, ensuring the proper lubrication of these bearings. Vent 56 allows entrapped air bubbles to escape from the propeller gear box 31.

Attached to the steering unit housing 28 is a line 57 which couples the interior of the housing 28 to a hydraulic cylinder which can pressurize the oil in the system. This hydraulic cylinder may be of the type commonly used as the master cylinder in an automobile braking system, or other commonly available devices well known to those familiar with this field. Pressuring means other than a hydraulic cylinder can also be used, and are considered to be within the scope of this invention.

Hand or foot operated control means for actuating the hydraulic cylinder or other pressurizing means can be remotely mounted, and will allow an operator to selectively increase or decrease the pressure of the lubricating oil, according to the amount of feathering desired.

Referring now to FIG. 5, the special mounting of the propeller blades, which enables them to be feathered by the selective pressurizing of lubricating oil or other fluid in the propeller system, will now be described. In this schematic, only one blade is shown in detail for clarity, and it will be understood that each individual propeller blade may be identical.

Affixed to the shaft 32 is a blade mount 58 having a bore forming a hydraulic cylinder 60 with pins 59 extending inward from its side. While one pin per blade mount may be sufficient, two or more will be present in a preferred embodiment. Propeller blade 62 is affixed to a piston 63 which extends into the cylinder 60. The piston 63 has one or more helical grooves 64 along its side into which the pins 59 extend, with the grooves 69 and pins 59 acting as cam and follower, and it is free to move vertically within the cylinder 60. The piston 63 will rotate due to the interaction of the grooves 64 and the pins 59 while it moves vertically.

The propeller shaft 32, as discussed above, has within it a bore 47 into which the lubricating oil of the propeller system flows. This bore 47 is in fluid communication with the hydraulic cylinder 60. When oil in the bore 47 is pressurized, it will exert upward pressure on the piston 63, causing the piston 63 to rise and rotate, thus feathering the propeller blade 62. This feathering system allows instantaneous control of propeller blade angle, thus greatly enhancing the maneuverability of a vessel on which it is used.

Still another novel feature of this invention is the shaft seal 66, which is shown in cross-sectional detail in FIG. 6. The seal 66 includes a casing or insert 67 which seats in an enlarged diameter recess in the end cover 37, and a sealing disc 68 mounted within an annular recess within the casing 67. In a preferred embodiment, the sealing disc 68 is thick, i.e., its thickness is large compared to its radius. The disc 68 has on either side an annular groove 69, and its edge is bifurcated by a peripheral groove 71 which, in the preferred embodiment, is deep, compared to the disc's radius. The shaft 32 is inserted in a hole in the center of the disc 68, which fits tightly on the shaft 32 and rotates with it. A metal reinforcing band 72 within the body of the disc is provided, to hold the disc in sealing contact with the shaft 32, although a spring could alternatively be used. To aid in the dispersion of heat due to friction, particles or pellets of a metal such as copper can be embedded within the disc, which can comprise butyl rubber or material of like resilient qualities. The casing 67 has its sidewalls 73 in contact with the sides of the disc 68, and its annular wall 74 in sealing contact with the disc's bifurcated edge. The casing 67 will preferably have a low coefficient of friction lining of material like TEFLON.

The casing 67 will have a plurality of exit paths 76 leading to its exterior. These paths will preferably be evenly spaced around the casing 67, and will be positioned near the upper rim of annular groove 69. As shaft 32 spins, any water or other fluid which seeps into the casing 67 will be cast outward by centrifugal force into the space between the resilient disc 68 and casing sidewall 73. The curve of the groove 69 will then direct the fluid out the exit path 76. Centrifugal force will also urge the bifurcated edge of the disc 68 into greater sealing contact with the annular wall 74 of the casing 67.

While this seal has special application with reference to its use in a marine propulsion unit, it will be understood by those skilled in the art that the seal may be used as a seal against liquids, dust or other matter, in other settings involving a spinning shaft.

In operation of the steering and propulsion system, the steering propeller 4 is positioned in the water and the engine or other prime mover 1 is started. When the engine is started with no braking pressure applied to the brake drum 17, the drum 17 will spin freely. However, the propeller 4 will not spin freely because of the resistance to its motion due to the water, and thus will not yet provide thrust for the vessel. As braking pressure is applied to the brake drum 17, the propeller 4 will be supplied with power to overcome the resistance of the water and supply thrust. The braking pressure will be varied by the operator to supply the amount of power needed for the desired thrust.

The operator will steer the vessel by activating the steering means 22 through means such as a flexible shaft drive. Feathering of the propeller blades can be accomplished when desired by activating the hydraulic cylinder (not shown) which pressurizes the oil in steering unit housing 28 through line 57.

Although a preferred embodiment of this invention has been described in detail, modifications of the described structure can be made without departing from the scope of the invention.

What is claimed is:

1. A marine propulsion device comprising:

prime mover drive means, marine propeller means, and means for supplying power to said propeller means in selectively variable amounts, including: a differential gearing unit including a power input drive shaft drivingly connected to said drive means, oppositely extending output driven shafts, gear means for differentially driving said output shafts from said power input shaft, and means for drivingly connecting said propeller means to one of said output shafts; and brake means for selectively applying braking pressure to the other of said output shafts, whereby power to said propeller means will be applied in direct proportion to the braking pressure applied by said brake means.

2. The propulsion device according to claim 1 including:

means for mounting said propulsion device to a marine hull with said one output shaft extending vertically downwardly to locate said propeller means beneath the surface of the water.

3. The propulsion device according to claim 2 including means for mounting said propeller means for selective rotation about the axis of said one output shaft for controlling the direction of thrust of said propeller means.

4. The propulsion device according to claims 1 or 3 wherein:

said differential gearing unit includes a housing means, said brake means comprises first and second friction braking elements mounted on said housing means and said other output shaft, and means for selectively actuating said braking elements for controlling the rotation of said other output shaft.

5. The propulsion device according to claim 4 wherein:

said first braking element comprises brake drum means carried on said other output shaft, said second braking element comprises brake shoe means carried by said housing, and said selectively actuating means comprises means for moving said brake shoes into engagement with said brake drum.

6. The propulsion device according to claim 1 wherein said propeller means includes:

a propeller shaft extending at right angles to said one output shaft;

said means for drivingly connecting said propeller means to said one output shaft comprising:

first gear means mounted on said one output shaft for rotation therewith, second gear means mounted on said propeller shaft in a first position for rotation therewith, said first and second gear means being in driving engagement in the first position of said second gear means to drive said propeller means in a given direction, and means for mounting said second gear and said propeller shaft in said propeller unit for movement of said second gear to a second position on said propeller shaft in driving engagement with said first gear on said one output shaft for driving said propeller means in said given direction during reverse rotation of said one output shaft.

7. The propulsion device according to claim 6 wherein said first gear means comprises a first spiral bevel gear and said second gear means comprises a second spiral bevel gear, said means for mounting said second spiral bevel gear providing said first position thereof on one side of said first spiral bevel gear and said second position thereof on the opposite side of said first spiral bevel gear.

8. An adjustable pitch propeller comprising:

a rotatable propeller shaft;

drive means to rotate the propeller shaft;

means for lubricating the drive means with a lubricating fluid;

propeller blade means;

means for mounting said propeller blade means on said propeller shaft for rotation therewith, said mounting means including means forming a fluid pressure cylinder therein;

said propeller blade means including piston means affixed thereto and located in said cylinder, a source of selectively variable fluid pressure acting on said piston means comprising a bore in the propeller shaft in fluid communication with the cylinder and with the lubricating means, and means to selectively pressurize the lubricating fluid; and cam and follower means acting between said piston means and said fluid pressure cylinder for rotating said piston relative to said cylinder during linear displacement thereof.

9. The propeller of claim 8 wherein the means for lubricating the drive means with a lubricating fluid comprises a housing surrounding the drive means and containing the lubricating fluid.

10. The propeller of claim 8 or 9 wherein the means to selectively pressurize the lubricating fluid comprises a hydraulic cylinder.

* * * * *